US006761799B2

(12) United States Patent
Tikka

(10) Patent No.: US 6,761,799 B2
(45) Date of Patent: Jul. 13, 2004

(54) METHOD AND ARRANGEMENT FOR COMBUSTING BLACK LIQUOR

(75) Inventor: Petri Tikka, Karhula (FI)

(73) Assignee: Andritz Oy (FI)

( * ) Notice: Subject to any disclaimer, the term of this patent is extended or adjusted under 35 U.S.C. 154(b) by 411 days.

(21) Appl. No.: 09/810,465

(22) Filed: Mar. 19, 2001

(65) Prior Publication Data

US 2001/0023750 A1 Sep. 27, 2001

(30) Foreign Application Priority Data

Mar. 24, 2000 (FI) ..... 2000 0686

(51) Int. Cl.[7] ..... D21C 11/06

(52) U.S. Cl. ..... 162/47; 162/46; 162/30.1; 159/2.1; 159/47.3; 159/DIG. 8

(58) Field of Search ..... 162/29, 30.1, 31, 162/46, 47; 159/2.1, 47.3, DIG. 8

(56) References Cited

U.S. PATENT DOCUMENTS

| | | | | |
|---|---|---|---|---|
| 3,718,446 A | | 2/1973 | Brink et al. | 48/111 |
| 3,765,377 A | | 10/1973 | Freiday | 122/7 |
| 4,944,840 A | * | 7/1990 | Henricson et al. | 162/46 |
| 5,089,087 A | * | 2/1992 | Elmore et al. | 162/46 |
| 5,509,997 A | | 4/1996 | Kuusio et al. | 162/16 |
| 6,176,971 B1 | * | 1/2001 | Sun Yu et al. | 162/29 |
| 6,179,958 B1 | * | 1/2001 | Lysen et al. | 162/17 |
| 6,235,151 B1 | * | 5/2001 | Fagerlind et al. | 162/48 |
| 6,306,252 B1 | * | 10/2001 | Ryham | 162/47 |

FOREIGN PATENT DOCUMENTS

| | | | |
|---|---|---|---|
| CA | 2195993 | | 7/1997 |
| EP | 0 839 949 | A1 | 5/1998 |
| WO | WO96/32531 | * | 10/1996 |
| WO | WO97/29236 | * | 8/1997 |

* cited by examiner

*Primary Examiner*—Dean T. Nguyen
(74) *Attorney, Agent, or Firm*—Nixon & Vanderhye P.C.

(57) ABSTRACT

The present invention relates to a method and an arrangement for use in connection with the combustion of black liquor. In the method the black liquor is concentrated in a multi-effect evaporation plant in order to obtain black liquor at a suitable dry-solids content for combustion and to generate vapor. The concentrated black liquor is taken to be combusted in a recovery boiler, into which combustion air is fed at several levels for the combustion process. It is a characteristic feature of the invention that the air fed to at least one air level is preheated by using vapor generated in the concentration of the black liquor as heat source.

20 Claims, 1 Drawing Sheet

METHOD AND ARRANGEMENT FOR COMBUSTING BLACK LIQUOR

BACKGROUND AND SUMMARY OF INVENTION

This invention relates to a method of and an arrangement for combusting black liquor from a pulp mill in a recovery boiler, whereby the heat economy of the process has been specifically enhanced.

Conventionally, the black liquor from a pulp mill has been combusted at a dry solids content of approximately 63–75%. It is advantageous to remove as much water as possible from the black liquor before feeding the liquor into a recovery boiler, because the vaporization of the water in the furnace cools the furnace, slows down the combustion process and, due to an increased heat capacity, impedes the recovery of the heat that has become bound in the flue gases during the combustion. At present, a purpose is to concentrate the black liquor to a considerably higher dry solids content (i.e. 80–90%), which provides several benefits in the combustion of black liquor. Liquor droplets having a high dry solids content dry faster and with a smaller amount of heat and they also burn quicker. A decreased flue gas flow allows the installation of smaller and inexpensive heat transfer surfaces and the possibility to position the post-heat transfer surfaces of the boiler so that more electricity can be produced. Also the risk of blocking in the heat recovery section of the recovery boiler will be smaller. An increase in the dry solids content raises the temperature at the bottom part of the furnace, whereby emissions of sulfur dioxide are lesser and the level of reduction in the char bed increases.

For the recovery the black liquor is concentrated in a multi-effect evaporation plant. Usually the evaporation plant operates so that hot vapor, e.g. live steam, is fed as heating medium into an evaporator at the highest pressure, said vapor boiling down the liquor on the liquor side of the evaporator, thus generating vapor at a lower pressure than the vapor directed to the vapor side of the evaporator. The vapor thus generated is used to heat an evaporator at the next highest pressure while the liquor flows through the evaporation plant countercurrent in relation to the heating steam. Correspondingly, the same process takes place in the third effect and in the fourth effect etc. until the pressure and the temperature of the liquor discharged from the last effect in relation to the flow of the vapor are so low that it is technically and economically unprofitable to continue. The vapor having the lowest pressure is usually condensed in a condenser by using water or air. Typically an evaporation plant has 5 to 7 effects.

Treatment of black liquor at a high dry solids content involves certain problems. The viscosity of the black liquor increases exponentially as the dry solids content increases. In order to overcome the resistance caused by the viscosity, the black liquor has to be evaporated and transferred to a recovery boiler at a high temperature and at a superatmospheric pressure. When the dry solids content of the black liquor is above 80%, the viscosity of the liquor is so high and the boiling point rise so considerable that ordinary back pressure steam is not sufficient for the final concentration. Medium pressure steam (typically having a pressure of 9–17 bar(e)) is required in order to reach a sufficiently high evaporation temperature in the final concentrator and to lower the viscosity of the liquor as well as to compensate the decrease in capacity caused by the considerable boiling point rise. Thus, the pressure and the temperature of the secondary vapor (its heat enthalpy) generated from the black liquor to be evaporated in the final concentrator will be so high that as regards heat economy, it is difficult to utilize this vapor as effectively as possible in the multi-effect evaporation plant described above, even though it would be a natural further use for the vapor. Feeding this kind of vapor into further effects operating at a lower dry solids content is not profitable, because as a heat source for these effects, vapor can be used having a lower pressure and temperature than the secondary vapor of the final concentrator.

It is an object of the invention to provide a method whereby the secondary vapor generated in the evaporation of the black liquor can be utilized more effectively as regards heat economy than before. In particular, it is a further object of the invention to provide a method of utilizing the secondary vapor that has been generated in the final evaporation of the black liquor to the dry solids content above 80%.

The present invention comprises a method whereby black liquor is concentrated in a multi-effect evaporation plant in order to obtain black liquor at a suitable dry-solids content for combustion and to generate vapor. The concentrated black liquor is taken to be combusted in a recovery boiler, into which combustion air is fed at several levels for the combustion process. It is a characteristic feature of the invention that the combustion air to be fed to at least one air level is preheated by using vapor generated in the concentration of the black liquor as a heat source.

The invention also relates to an arrangement for combusting black liquor from a pulp mill, the characteristic features of which being defined in the appended claims relating to the arrangement.

In the new process of the invention the vapor produced in the concentration of black liquor is utilized in an entirely new way as it is used to preheat the combustion air needed for the combustion of black liquor subsequent to the evaporation plant. Secondary vapor that is particularly suitable for this purpose is produced in the final concentration of the black liquor, whereby the dry solids content of the black liquor rises above 80% and whereby medium pressure steam having typically a pressure of 10–12 bar is used as heating medium.

When combusting concentrated black liquor, the purpose is to separate from each other the organic and inorganic constituents of the dry solids in the black liquor. The heat from the organic constituent of the dry solids is recovered and this heat is used to produce as much steam as possible. Process chemicals are recovered from the inorganic constituent of the dry solids in such a form that at later stages of the process they can be transformed to be reused in the cooking process. The concentrated black liquor is sprayed in a droplet form into the furnace of the recovery boiler. Also fed into the furnace of the recovery boiler is a stoichiometric amount of combustion air corresponding the amount of black liquor and also some surplus air to ensure complete combustion. Air is usually fed in at three levels: primary air at the bottom of the furnace, secondary air above the level of the primary air but below the liquor nozzles, and tertiary air above liquor nozzles in order to ensure complete combustion. In addition to these, there may also be other levels for feeding in air, e.g. above the tertiary air level, whereby the object is to decrease the amount of nitrogen oxides formed in the combustion.

Conventionally, at least the primary and secondary air is pre-heated before feeding into the furnace in order to maintain a sufficiently high combustion temperature in the furnace. Ambient air is used as the tertiary air and the air for the higher levels, and it is usually not heated. In the preheating the combustion air is heated typically to a temperature of approx. 150° C. The heating process is usually divided into two stages, of which the first stage utilizes low pressure steam, e.g. at the pressure of approx. 3 bar, and the second stage uses steam at a higher pressure, e.g. at approx. 11 bar. When combusting black liquor having dry solids content above 80% in the recovery boiler, the temperature of the combustion air to be fed into the furnace of the boiler is lower than the corresponding temperature in the combustion of lower-solids black liquor. Typically, the temperature of the air is about 100° C., which makes it possible to use steam having a lower pressure than the normal low pressure steam (approx. 3–4 bar(e)) of the mill in the air pre-heaters, and therefore, according to the invention, heat originating from the secondary vapor is utilized. Consequently, a steam pressure of approx. 0,5–1 bar(e) is sufficient in the air pre-heater.

The process according to the invention is very economical as regards heat consumption, because the heat used for the evaporation of the black liquor is recovered to be further used for heating the combustion air for the recovery boiler. In this way, the heat that is required for pre-heating the air may be used twice; first to evaporate the black liquor and then to pre-heat the air.

The process according to the invention is particularly suited for pulp mills, where black liquor has previously been concentrated to a dry solids content of 70–75%, but in order to enhance the combustion, the aim is to reach the level above 80%. In certain exemplary cases it has been shown that in additional evaporation where the black liquor has been concentrated further to a dry solids content of above 80%, the heat energy thus generated is approximately 70–90% of the energy needed to preheat the combustion air. The required additional heating of the combustion air is provided by heating separately with live steam which is usually needed in the system for start-ups and shutdowns and for regulating the process.

It is fairly uncomplicated to apply the invention in an existing plant as the number of connections to the evaporation plant and the boiler is small. Due to a lesser need for connections required for the realization of the arrangement according to the method of the invention, it is relatively easy to position the arrangement in connection with the recovery boiler. The heat consumption of the mill does not increase even though a new black liquor concentrator using medium pressure steam as heating medium is installed in the mill, because the vapor generated in the concentrator is utilized further in a heat-economical way, i.e. in the air pre-heaters. Additional operating costs resulting e.g. from a decrease in the production of electricity in the mill, which is caused by replacing the low pressure steam used in the pre-heating with the medium pressure steam used for evaporation, is merely a small portion in comparison with the yield from the additional steam production from the evaporation (i.e. secondary vapor from the concentrator).

The secondary vapor originating from the black liquor may include corroding compounds to such an extent that the material of which the air pre-heater is manufactured must have certain special properties, if the secondary vapor is led directly to the pre-heaters. According to a preferred embodiment of the invention, the secondary vapor is condensed in an evaporation unit (a reboiler) in which the condensing medium is demineralized water or the like. The steam thus generated is so pure that it may be fed into the same line with the live steam directed to the air pre-heaters. In the pre-heaters the air is condensed and the condensate is returned to the reboiler. When using the evaporation unit as an intermediate loop boiling demineralized water, no special arrangements are needed for the material of the air pre-heater. The pre-heating can be realized also without an intermediate loop (reboiler) if the secondary vapor used as a heat source does not contain to a damaging extent substances that can affect an air pre-heater manufactured of conventional material and having a conventional construction.

SUMMARY OF THE DRAWING

The invention is described in detail with reference to the accompanying FIG. 1, which illustrates schematically a preferred arrangement for realizing the method according to the invention.

DETAILED DESCRIPTION OF THE INVENTION

Figure 1:
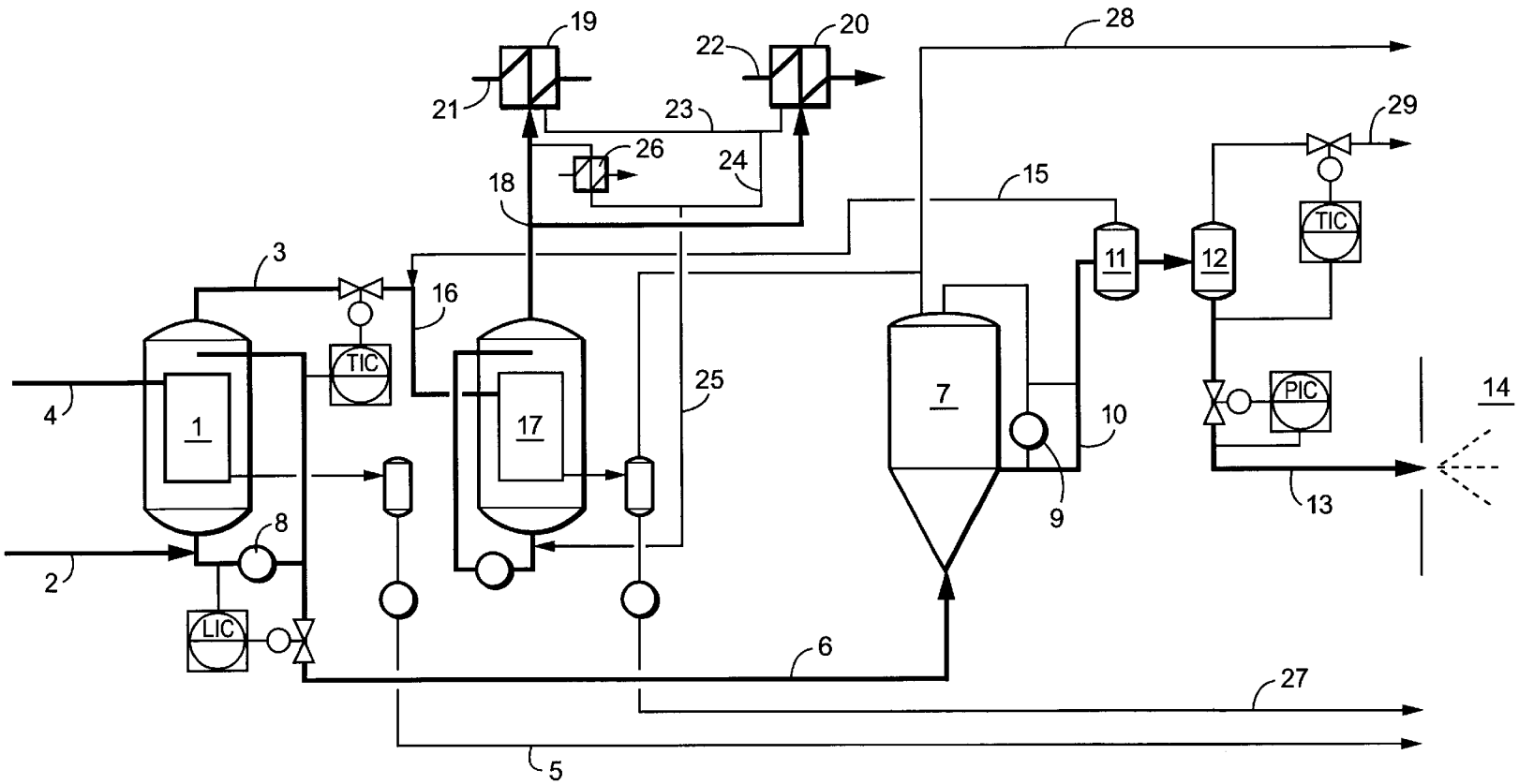

The black liquor evaporated in a multi-effect evaporation plant is fed from an atmospheric storage tank (not illustrated) via line 2 to a concentrator 1. Liquor is heated by means of medium pressure steam (e.g. at the pressure of 11–12 bar) directed in via line 4, and the clean condensate is removed via line 5 for further use e.g. at the mill power plant. The black liquor is evaporated in the concentrator to a desired dry solids content, preferably above 80%. Secondary vapor to the line 3 is obtained from the top of the concentrator, said vapor being then utilized to pre-heat the air needed for the combustion of the black liquor. As a concentrator 1, an evaporator of lamella type is presented, in which the black liquor to be evaporated flows in a thin film on the outer surface of the lamella. The black liquor is circulated to the upper part of the lamellas by means of a circulation pump 8. The concentrator may also have another kind of structure, e.g. a heat transfer surface constructed of tubes.

The concentrator operates at a super-atmospheric pressure and at a temperature of preferably 160–190° C. The evaporation temperature is regulated by throttling the flow of secondary vapor in the line 3. The liquor is pumped or allowed to flow into a pressurized tank 7 via line 6. During the entire treatment of the black liquor, the pressure and the temperature are to be maintained at such values where the viscosity of the black liquor is so low that the black liquor can be transferred by allowing it to flow or by pumping. The retention time in the tank 7 is dimensioned e.g. for washing the concentrator 1. The tank 7 is equipped with a mixer and a circulation pump 9 so that the quality of the black liquor to be taken to the combustion would be as homogenous as possible.

The black liquor is taken from the tank 7 via line 10 into two flash tanks 11 and 12 by means of the pressure difference prevailing between the tank 7 and the flash tanks, whereby pumps are not needed for the transfer. The black liquor is flashed in the flash tanks to regulate the combustion temperature. From the flash tank 12 the liquor is taken via line 13 to be combusted in a recovery boiler 14, into which the liquor is sprayed. The flash tanks are positioned at a level so much higher in relation to the spray level of the liquor that the difference in the levels is sufficient to create the pressure required for the spraying. This is a great advantage as there is no need for boiler liquor pumps with controllable speed, of which there usually are two and which may involve several kinds of problems. If under some circumstances the pressure in the tank 7 is not sufficient to move the liquor into the flash tanks 11 and 12, it is possible to use the circulation pump 9 of the tank 7.

The vapor obtained from the flash tanks 11 and 12 is utilized at the mill. The vapor in line 29 obtained from the flash tank 12, which is the latter of the tanks in the flow direction of the liquor, is taken to a suitable location at the black liquor evaporation plant, said location being situated prior to the concentrator 1 and at which location the energy in the vapor can be used again 2 to 4 times. The vapor from the first flash tank 11 in line 15 is utilized along with the secondary vapor obtained from the concentrator 1 via line 3 for pre-heating the combustion air for the recovery boiler. For this purpose the vapor flows from the lines 3 and 15 are directed to a line 16 via which the combination of vapor flows is led into an evaporation unit (reboiler) 17, which in this embodiment is also an evaporator of lamella type based on falling film principle, but which may also have some other kind of structure. The vapors are condensed in the reboiler 17 by using demineralized water as condensing medium. Steam thus produced is taken via line 18 to a pre-heater 19 for the primary air and to a pre-heater 20 for the secondary air to heat the combustion air flows entering via lines 21 and 22. Since the steam generated in the reboiler 17 is formed of demineralized water, it is so pure that it can be lead into conventional air pre-heaters. Air flows heated in the pre-heaters 19 and 20 are directed to the furnace 14 of the recovery boiler.

The steam is condensed by using the pre-heaters 19 and 20 and the condensate thus formed is returned via lines 23, 24 and 25 to the reboiler 17 to be reused as condensing medium. If the evaporation of black liquor in the concentrator 1 has generated more heat than what is needed to pre-heat the combustion air, the excess heat can be removed from the process by directing steam from line 18 to an auxiliary condenser 26 where the heat is utilized to produce hot water.

A foul condensate from the reboiler 17 is taken via line 27 to the evaporation units located prior to the concentrator to be purified together with foul condensates from the evaporator. The vent gases from the tank 7 and the reboiler 17 are taken via line 28 to the vacuum system of the evaporation plant or to the treatment system for low-volume high-concentration gases.

By means of the present invention evaporation of the black liquor that is to be concentrated to a very high dry solids content can be made very profitable as regards the mill heat economy, when the heat generated in the evaporation is utilized at a later stage of the treatment of the black liquor, i.e. the combustion. The above embodiment has described the use of the vapor produced in the final evaporation stage, but also vapor generated in other evaporation stages may be used, if the properties of the vapor are suitable for the purpose.

What is claimed is:

1. A method of combusting black liquor from a pulp mill comprising the steps of:

concentrating black liquor in a multi-effect evaporation plant to generate a black liquor concentrate having a suitable dry-solids content for combustion and to generate vapor, and combusting the black liquor concentrate in a recovery boiler, into which combustion air is fed at several air levels of the boiler for the combustion process so that the combustion air to be fed to at least one air level is preheated by using vapor generated in the concentration of the black liquor as heat source.

2. A method according to claim 1, wherein the vapor is steam generated by a final concentration stage of the black liquor, from which stage the black liquor concentrate is fed to the boiler for combustion.

3. A method according to claim 2, wherein the black liquor concentrate has a dry solids content of about 80% and a heating medium for concentrating the black liquor is medium pressure steam.

4. A method according to claim 1 further comprising a step of condensing the vapor generated during the concentration of the black liquor by using water as a condensing medium, and said water generates steam that is taken to pre-heat the combustion air.

5. A method according to claim 4 wherein the steam generated from the water is condensed in the pre-heating of the air and generates a condensate which is returned to be used as a condensing medium to condense the vapor.

6. A method according to claim 1, wherein the black liquor is flashed after a final stage of concentration and flashed vapor is used as a heat source for pre-heating the combustion air.

7. A method according to claim 1, wherein primary combustion air supplied to the boiler is pre-heated.

8. A method according to claim 1, wherein secondary combustion air supplied to the boiler is pre-heated.

9. A method to combust black liquor from a pulp mill comprising the steps of:

a. concentrating the black liquor in a multi-effect evaporation plant to generate black liquor having a dry-solids content level and vapor;

b. combusting the black liquor with the dry-solids content level in a recovery boiler;

c. injecting combustion air into the recovery boiler at a plurality of levels of the boiler; and d. preheating the combustion air injected at least at one of said levels using heat from the vapor generated in concentrating the black liquor.

10. A method of combusting black liquor from a pulp mil comprising:

concentrating black liquor in a multi-effect evaporation plant having a final concentration stage to generate a black liquor concentrate having a suitable dry-solids content for combustion and to generate vapor, and combusting the black liquor concentrate from the final concentration stage in a recovery boiler, feeding combustion air into several air levels of the recovery boiler for a combustion process, the combustion air fed to at least one of said air levels is preheated by using vapor generated in the final concentration stage as a heat source.

11. A method according to claim 10 wherein the black liquor concentrate has a dry solids content of about 80% and a heating medium for concentrating the black liquor is medium pressure steam.

12. A method according to claim 10 further comprising a step of condensing the vapor generated during the concentration of the black liquor by using water as a condensing medium, and said water generates steam that is taken to pre-heat the combustion air.

13. A method according to claim 12 wherein the steam generated from the water is condensed in the pre-heating of the air and generates a condensate which is returned to be used as a condensing medium to condense the vapor.

14. A method according to claim 10 wherein the black liquor is flashed after the final concentration stage and the flashed vapor preheats the combustion air.

15. An arrangement for combusting black liquor from a pulp mill, said arrangement comprising:

a recovery boiler for combusting the black liquor;

at least one air pre-heater connected to the recovery boiler for feeding pre-heated air into the furnace;

a multi-effect evaporation plant, wherein the black liquor is evaporated to a suitable dry solids content for combustion and wherein a final evaporation stage in a flow direction of the liquor is connected to the recovery boiler to feed black liquor into the boiler; and wherein the final evaporation stage is connected at least one air pre-heater so that heat from evaporation is used to heat air in the pre-heater.

16. An arrangement according to claim 15, comprising a reboiler connected to the final evaporation stage, for directing the vapor generated by evaporation to the reboiler to be condensed by using water as a condensing medium and said reboiler being further connected to an air pre-heater for directing steam generated from the water in the reboiler into the air pre-heater.

17. An arrangement according to claim 15, wherein the final evaporation stage is connected to the recovery boiler at least by one flash tank, said tank being connected to the air pre-heater to apply flashed vapor generated of the black liquor in the pre-heater.

18. An arrangement according to claim 15, wherein the air pre-heater is a pre-heater for primary air supplied to the reboiler.

19. An arrangement according to claim 15, wherein the air pre-heater is a pre-heater for secondary air supplied to the reboiler.

20. An apparatus for combusting black liquor from a pulp mill comprising:

a recovery boiler to combust evaporated black liquor;

at least one pre-heater providing pre-heated combustion air to the recovery boiler;

a multi-effect evaporation plant evaporating black liquor to a suitable dry solids content, and a multi-effect evaporation plant generating the evaporated black liquor having a suitable dry solid content and vapor, wherein said evaporated black liquor is fed from the evaporation plant to the recovery boiler, and the vapor generated by the plant pre-heats combustion air to provide said pre-heated combustion air.

* * * * *